US007173176B2

(12) United States Patent
Nybye

(10) Patent No.: US 7,173,176 B2
(45) Date of Patent: Feb. 6, 2007

(54) DRUMSTICK AND METHOD OF MAKING SAME

(75) Inventor: Lance S. Nybye, Valley Center, CA (US)

(73) Assignee: Lance S. Nybye, Sr., Valley Center, CA (US)

( * ) Notice: Subject to any disclaimer, the term of this patent is extended or adjusted under 35 U.S.C. 154(b) by 0 days.

(21) Appl. No.: 10/980,946

(22) Filed: Nov. 3, 2004

(65) Prior Publication Data

US 2006/0090629 A1 May 4, 2006

(51) Int. Cl.
*G10C 3/12* (2006.01)

(52) U.S. Cl. ..... 84/422.4

(58) Field of Classification Search ..... 84/422.4
See application file for complete search history.

(56) References Cited

U.S. PATENT DOCUMENTS 3,859,887 A * 1/1975 Buchanan ..... 84/422.4
4,905,566 A * 3/1990 Hughlett et al. ..... 84/422.4
5,370,030 A * 12/1994 Horne ..... 84/422.4
5,400,685 A * 3/1995 Cappella ..... 84/422.4
5,693,900 A * 12/1997 Calato et al. ..... 84/422.4

* cited by examiner

*Primary Examiner*—Kimberly Lockett
(74) *Attorney, Agent, or Firm*—Duckor Spradling Metzger & Wynne; Bernard L. Kleinke

(57) ABSTRACT

A drumstick and method of making it are disclosed, wherein a rigid ring is fixed to a drumstick body. The ring is disposed substantially at a pivot point located at a position disposed sufficiently rearwardly from the drumstick body tip that the majority of the weight of the body is disposed forwardly of the ring. The predetermined distance is determined by supporting the drumstick body between a fulcrum and a scale, and moving the fulcrum and the scale relative to one another until the scale reads a certain percentage of the weight of the drumstick body to determine where the pivot point is located on the body.

17 Claims, 2 Drawing Sheets

DRUMSTICK AND METHOD OF MAKING SAME

FIELD OF THE INVENTION

The present invention in general relates to a drumstick and a method of making it. It more particularly relates to the construction of a drumstick to enable a person to perform intricate twirling movements of the drumstick while maintaining the rhythm of playing a percussion instrument, such as a drum or cymbal.

BACKGROUND ART

There is no admission that the background art disclosed in this section legally constitutes prior art.

Various different types and kinds of drumsticks and the like have been employed for playing percussion instruments, such as drums and cymbals. Some performers are able to twirl the drumsticks in an artful manner during the playing of the percussion instruments. The twirling manipulation is accomplished while maintaining the rhythm or beat of the percussion instruments.

Very few performers are able to achieve such a difficult manipulation. As a result, there have been attempts to design modified drumsticks to be used to accomplish such difficult manipulations by less highly skilled performers. In this regard, reference may be made to the following patents and patent applications:

U.S. Pat. Nos.

5,370,030
3,365,108
3,859,887
5,581,031
6,365,813
6,271,451
Des. Pat. No. 297546

Foreign Applications and Patents

French Publication 2 792 102
WIPO PCT Publication WO 03/005338 A1
WIPO PCT Publication WO 86/02849
UK Patent Office Publication 1 572 531
Japanese Application 08240641
Japanese Publication 52062011 A2
Chinese Publication 2356398U

BRIEF DESCRIPTION OF THE DRAWINGS

The features of this invention and the manner of attaining them will become apparent, and the invention itself will be best understood by reference to the following description of certain embodiments of the invention taken in conjunction with the accompanying drawings, wherein.

DETAILED DESCRIPTION OF CERTAIN EMBODIMENTS OF THE INVENTION

Figure 1:
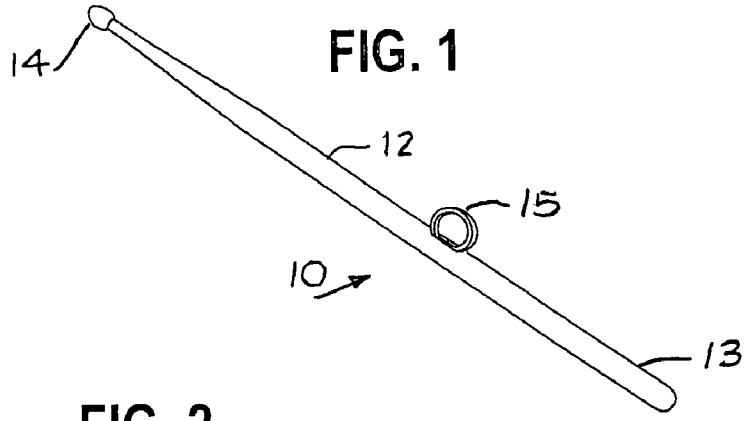
FIG. 1 is a pictorial view of a drumstick, which is constructed in accordance with an embodiment of the invention.

It will be readily understood that the components of the embodiments as generally described and illustrated in the drawings herein, could be arranged and designed in a wide variety of different configurations. Thus, the following more detailed description of the embodiments of the system, components and method of the present invention, as represented in the drawings, is not intended to limit the scope of the invention, as claimed, but is merely representative of the embodiment of the invention.

A drumstick and method of making it are disclosed, wherein a rigid ring is fixed to a drumstick body. The ring is disposed substantially at a pivot point located at a position disposed sufficiently rearwardly from the drumstick body tip that the majority of the weight of the body is disposed forwardly of the ring. The predetermined distance is determined by supporting the drumstick body between a fulcrum and a scale, and moving the fulcrum and the scale relative to one another until the scale reads a certain percentage of the weight of the drumstick body to determine where the pivot point is located on the body.

According to other disclosed embodiments of the invention, about 64 percent of the weight of the drumstick body is disposed forwardly of the ring.

According to still other disclosed embodiments of the invention, the drumstick body includes a longitudinally extending slot, and the ring is disposed at least partially within the slot. As disclosed herein, the slot includes a generally curved portion having a bottom blind hole.

According to other embodiments of the invention, the ring includes a tang, which may be imbedded in the drumstick body, such as by inserting it within the bottom blind hole in the slot.

As disclosed herein, a method of making the drumstick includes determining the predetermined distance between the ring and the tip, by supporting the drumstick body between a fulcrum and a scale. The fulcrum and the scale are moved relative to one another until the scale reads a certain percentage of the weight of the drumstick body to determine where the pivot point is located on the body.

Figure 2:
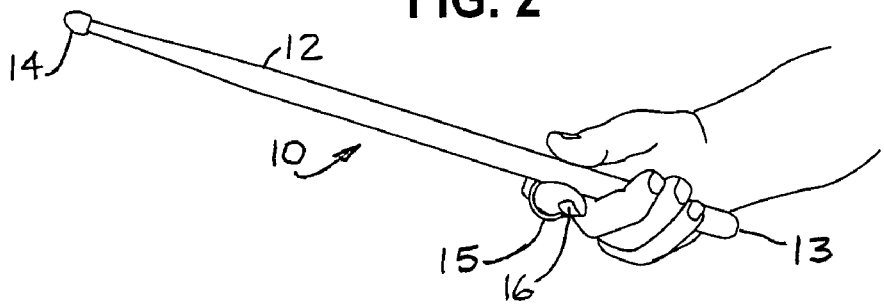
FIG. 2 is a pictorial view of the drumstick of FIG. 1, illustrating it in the process of being used to play a percussion instrument in a conventional manner.
Figure 3:
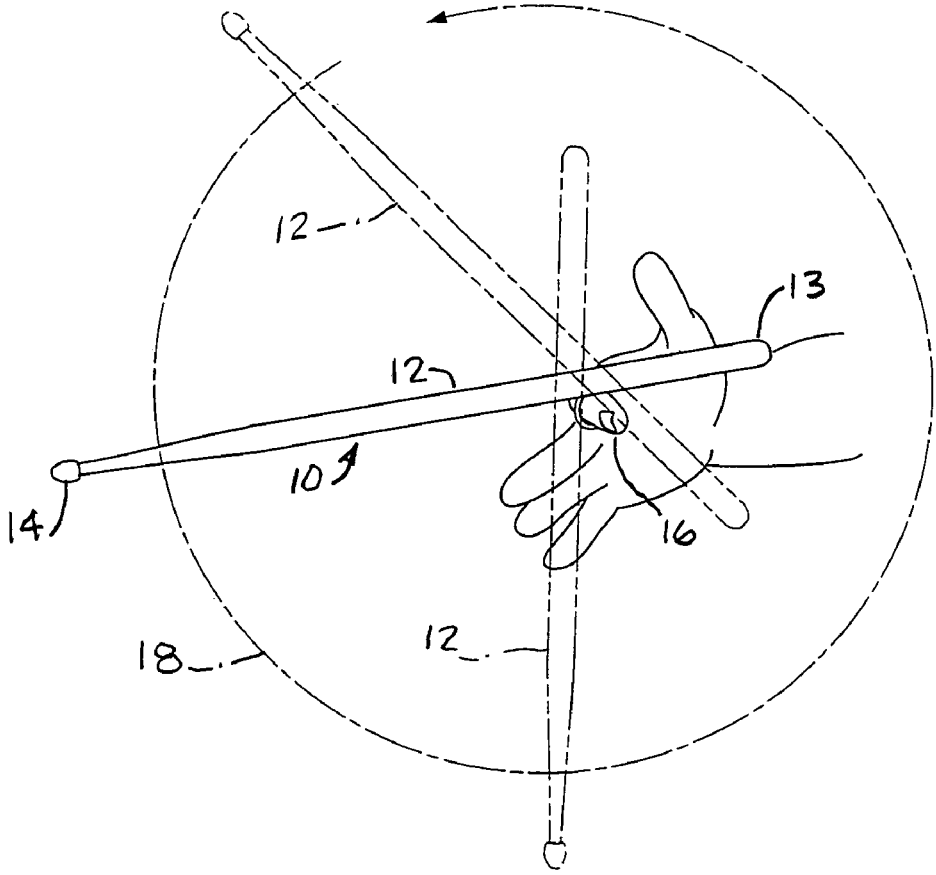
FIG. 3 is a slightly enlarged scale pictorial view of the drumstick of FIG. 1, illustrating it in the process of being twirled about the finger of the user.
Figure 4:
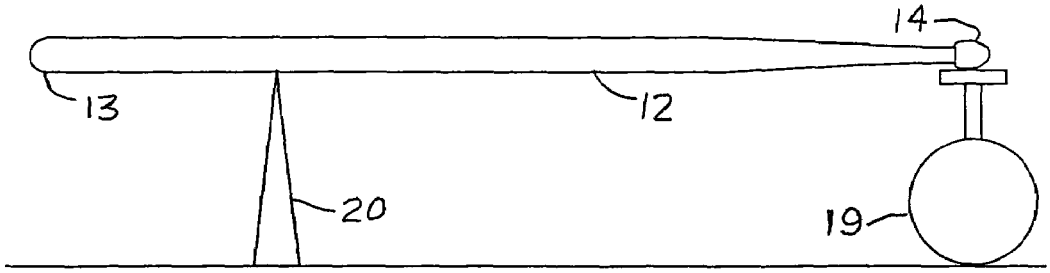
FIGS. 4 through 8 are diagrammatic views of the process for making the drumstick of FIG. 1.

Referring now to the drawings, and more particularly to FIGS. 1 through 3 thereof, there is shown a drumstick 10, which is constructed in accordance with an embodiment of the invention. As shown in FIG. 2, the drumstick 10 may be used in a conventional manner by being held in the hand of the user for playing percussion instruments, such as drums and cymbals. As shown in FIG. 3, the drumstick 10 may also be twirled about the index finger of the user in time with the music.

The drumstick 10 includes an elongated drumstick body 12 having a tail or handle 13 and a tip 14. The body 12 may be composed of wood and tapered in a conventional manner. A rigid finger ring 15 is fixed to the drumstick body 12 at a pivot point, which is located at a position disposed sufficiently rearwardly from the tip 14 that the majority of the weight of the drumstick body 12 is disposed forwardly of the ring 15. As hereinafter described in greater detail, in accordance with an embodiment of the invention relating to a specific model of drumstick, about 64 percent of the weight of the drumstick body 12 is disposed forwardly of the ring 15.

As shown in FIG. 2, during normal operation, the hand of the user grasps the handle 13 of the drumstick 10 with an index finger 16 being bent and inserted through the ring 15 with the thumb placed in opposition to the index finger 16 on top of the handle portion 13. In this manner, the user is able to play a conventional percussion instrument (not shown) in a conventional manner. As shown in FIG. 3, during the actual playing of the percussion instrument or at any desired time, the user is able to spin or rotate the drumstick 10 about the index finger 16 in a circular path of rotation 18 in time with the music being played. For example, the user can rotate or spin the drumstick 10 for three beats of music before commencing further playing of the drum or cymbal.

Referring now to FIGS. 4 through 8, the method of making the drumstick 10 according to another embodiment of the invention will now be considered in greater detail. In order to commence the method of making the drumstick 10, the location for the ring 15 is first determined. According to the disclosed embodiment of the present invention as hereinafter described in greater detail, one portion, such as the tip 14, of the drumstick body 12 is placed in supporting relationship on a scale 19 or other weight measuring device, and another portion of the body 12 is supported on a moveable fulcrum 20. The fulcrum 20 is moved relative to the scale 19, and the reading of the weights by the scale 19 is observed until the desired weight distribution is achieved, as hereinafter described in further detail in connection with FIG. 9 of the drawings. At this point, the fulcrum 20 is located at the desired position for the ring 15.

Figure 5:
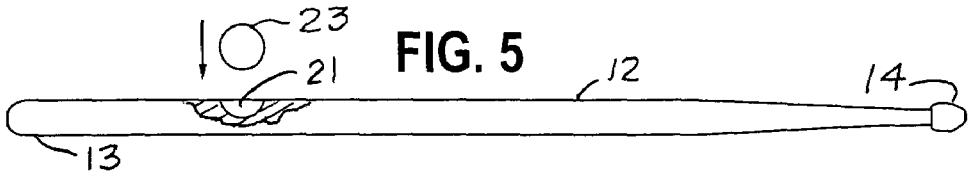
Figure 6:
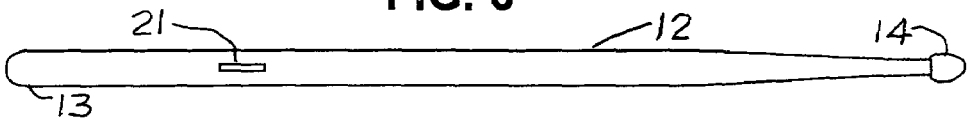
Figure 7:
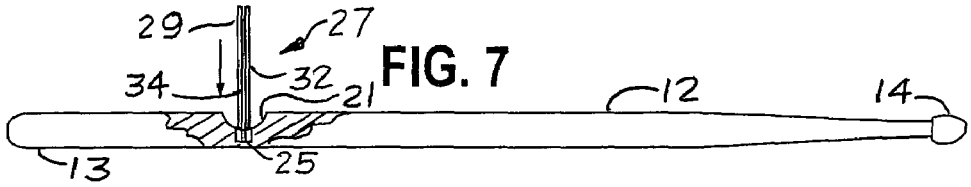

As shown in FIG. 5, a slot or kurf 21 is cut into the body 12 by a saw blade 23. The resulting slot 21 is curved or semi-circular in shape. The slot 21 extends axially or longitudinally along the body 12 as indicated in FIG. 6. In one embodiment of the invention, a slot 21 was formed in a rectangular shape having a width of 0.125 inch to receive a ring 15 having a thickness of 0.135 inch.

A blind hole 25 may be formed by a set 27 of three drill bits. In this regard, three holes are drilled side by side in the center of the slot 21 with the first center hole being directly in alignment with the pivot point by means of a drill bit 34, and the other two holes are drilled on each side of the first hole by a pair of outer drill bits 29 and 32. The center drill bit 34 is shown in the blind hole 25 in FIG. 7. The three holes are drilled to about 90 percent of the overall diameter of the drumstick body 12 to form the blind hole 25. This depth may vary slightly depending upon the drumstick model, such as model 5A or model 5B.

Figure 8:
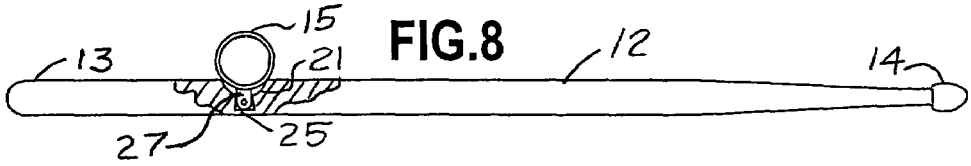

As shown in FIG. 8, the ring 15 may be a stamped or molded ring having a small aperatured tang 27 for receipt in the blind hole 25 for helping to anchor the ring in place. The ring may be made from suitable metal materials, such as steel, brass or suitable rigid or semi-rigid non-stick durable material. The ring is pressed into the cavity or slot 21 with a suitable liquid adhesive to help secure the ring 15 in place rigidly. A ball bearing assembly (not shown) may be assembled to the ring 15 to facilitate still further the ability to spin the drumstick about the user's finger at a high rate of speed.

The ring 15 may vary in size and it is presently contemplated that they may vary in ring sizes between 9 and 12. The tang or tab 27 is perforated and has a rounded bottom portion. In an actual model built and tested, a tang was integrally formed with the ring and was about 0.25 inch by about 0.25 inch.

The ring 15 may be slightly thicker than the width of the slot 21, and thus the ring 15 is pressed or forced partially into the slot 21 with the tang 27 engaging the bottom blind hole 25 as shown in FIG. 8. The depth of the ring 15 is set so the inside diameter of the ring opening is slightly below the surface of the drumstick body 12. In this manner, the index finger 16 is allowed to rest naturally and comfortably on the drumstick 10 as it would if there were no ring present, to facilitate using a conventional grip when the ring 15 is not being utilized for twirling the drumstick.

The slot may have a smaller radius of curvature as compared to the radius of curvature of the ring 15 as best seen in FIG. 8.

The balance and pivot point may be verified and checked by hanging or otherwise suspending the drumsticks in matched finish pairs upside down with a rigid pin through the rings such as the ring 15. When the paired sticks hang by their rings together, their angle may match within 0.125 inch. This balance may be important, because the drummer may alternate the drumsticks between the right and left hand. Also, any inconsistency in weight or balance may confuse the muscle memory of the drummer, and the muscle memory may be a key aspect of percussive proficiency and learning speed for some applications.

In order to control the momentum, direction and speed (rhythm) of a drumstick, each drummer may grasp a drumstick and feel his or her way to an optimum or desirable pivot point where he or she holds the drumstick between their index finger and thumb. This holding point may be used along with the remaining three fingers to control how the stick bounces or rebounds from the drum head or cymbal.

It has been determined through research that within a small tolerance, this natural pivot point corresponds to the optimum or highly desirable pivot point for efficient and controlled flipping, spinning, and multiple impact sticking. In this regard, it has been determined that for substantially all applications, a tip weight differential of about 64 percent of the overall weight of the drumstick between the ring and the tip is optimum or highly desirable for peak performance in most or many drumstick designs such as conventional model 5A and model 5B drumsticks.

Figure 9:
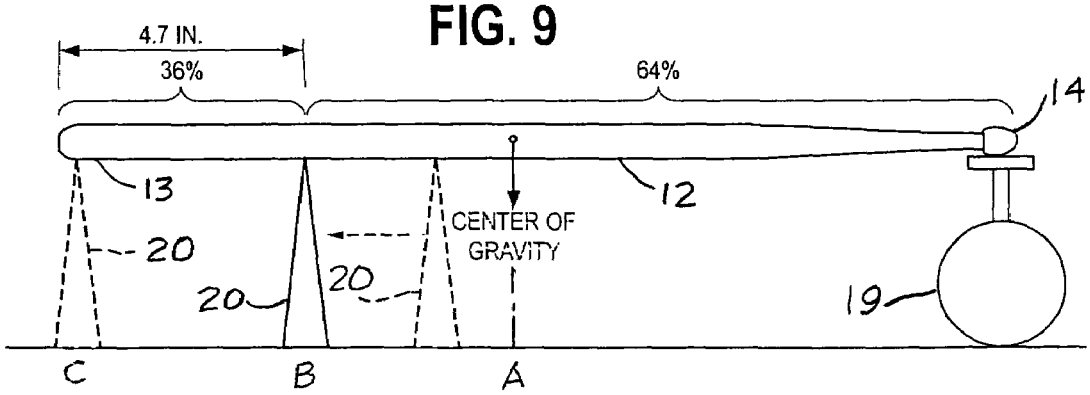
FIG. 9 is a diagrammatic view illustrating the process for determining the location of a rigid ring of the drumstick of FIG. 1.

In order to determine the location of the pivot point location for the ring 15, a drumstick body such as the drumstick body 12 is, for example, a pre-balanced model 5A drumstick that is 16 inches in length and weighs about 51 grams. As shown in FIG. 9, with the tip 14 of the drumstick body 12 resting on the scale 19 and the fulcrum point 20, the fulcrum point 19 may be moved backwardly on the stick until the tip weight on the scale 19 reads about 19 grams. This optimum or highly desirable pivot point has been established to be about 4.7 inches from the tail 13 of the drumstick body 12. This linear dimension remains constant within acceptable tolerances for substantially all drumsticks of this style (model 5A) and weight (51 grams).

As indicated in the diagram of FIG. 9, with the fulcrum 20 located at position A in alignment with the center of gravity of the drumstick body 12, the scale 19 would register approximately a zero weight. Alternatively, with the fulcrum 20 positioned at the tail 13, the weight would be supported substantially equally between the tip and the tail, and thus the scale 19 may register about 25.5 grams or one-half of the overall weight of the body 12. When the fulcrum 20 is disposed at position B (the desired pivot point), approximately 64 percent of the overall weight is disposed forwardly from the fulcrum 20 to the tip 14, and about 36 percent of the weight is disposed rearwardly to the tail 13. At this position, the center of the slot 21 may be formed approximately 4.7 inches from the tail 13 to achieve the desired weight distribution of about 64 percent of the weight forwardly of the ring 15.

By the proper positioning of the ring 15, and causing the weight distribution to be approximately 64 percent of the overall weight forwardly of the ring 15, the drummer can spin the drumstick 10 about his or her index finger 16 almost effortlessly as the weight of the drumstick causes the spinning action to continue. This facilitates the continued spinning or twirling manipulation of the drumstick 10 so that the drummer can maintain his or her concentration on the rhythm to coordinate the spinning with the playing of the instrument.

While particular embodiments of the present invention have been disclosed, it is to be understood that various different modifications are possible and are contemplated within the true spirit and scope of the appended claims. There is no intention, therefore, of limitations to the exact abstract or disclosure herein presented.

What is claimed is:

1. A drumstick comprising:

an elongated body having a tail, a tip, and a longitudinally extending slot; the slot including a blind hole; and a rigid ring rigidly fixed to the body, the ring having a radially outwardly extending tang rigidly connected to the ring, the ring being disposed substantially at a pivot point at least partially within the slot, and the tang being disposed substantially within the blind hole to prevent movement of the ring within the slot, and wherein the entire ring is fixed in a stationary position relative to the body, wherein the pivot point is located at a position disposed sufficiently rearwardly from the tip that the majority of the weight of the drumstick body is disposed forwardly of the ring.

2. A drumstick according to claim 1, wherein about 64 percent of the weight of the drumstick body is disposed forwardly of the ring.

3. A drumstick according to claim 1, wherein the slot includes a generally curved portion having a bottom including the blind hole.

4. A drumstick according to claim 3, further including an adhesive disposed within the slot.

5. A drumstick according to claim 3, wherein the ring is generally circular and the slot is generally semi-circular having a smaller radius of curvature than the radius of curvature of the ring.

6. A drumstick according to claim 3, wherein the ring is composed of metal material.

7. A drumstick according to claim 6, wherein the metal is selected from the group consisting of steel and brass.

8. A drumstick according to claim 1, wherein the ring has a thickness slightly greater than the width of the slot to help fixedly engage the ring at least partially within the slot.

9. A method of making a drumstick, comprising:

providing a drumstick body having a tip and a tail;

forming a longitudinally extending opening in the body at a predetermined distance from the tip at a pivot point disposed sufficiently rearwardly from the tip at the majority of the weight of the drumstick body is disposed forwardly of the opening;

forming a blind hole in the opening; and rigidly fixing a rigid ring having a radially outwardly extending tang rigidly connected to the ring, the ring being disposed at least partially within the opening with the tang at least partially disposed within the blind hole to prevent movement of the ring within the opening, wherein the entire ring is fixed in a stationary position relative to the body.

10. A method according to claim 9, wherein the fixing of the ring includes using a suitable adhesive.

11. A method according to claim 9, wherein the forming of the opening includes cutting a curved slot in the drumstick body.

12. A method according to claim 9, wherein the predetermined distance is determined by supporting the drumstick body between a fulcrum and a scale, and moving the fulcrum and the scale relative to one another until the scale reads a certain percentage of the weight of the drumstick body to determine where the pivot point is located on the body.

13. A method according to claim 12, further including positioning the scale at one end of the body and moving the fulcrum until the scale indicates desired percentage of the weight of the body.

14. A method according to claim 13, wherein the scale is positioned at the tip of the body.

15. A method of making a drumstick, comprising:

providing a drumstick body having a tip and a tail;

forming an opening in the body at a predetermined distance from the tip at a pivot point disposed sufficiently rearwardly from the tip that the majority of the weight of the drumstick body is disposed forwardly of the opening; and fixing a rigid ring at least partially within the opening, wherein the predetermined distance is determined by supporting the drumstick body between a fulcrum and a scale, and moving the fulcrum and the scale relative to one another until the scale reads a certain percentage of the weight of the drumstick body to determine where the pivot point is located on the body.

16. A method according to claim 15, further including positioning the scale at one end of the body and moving the fulcrum until the scale indicates desired percentage of the weight of the body.

17. A method according to claim 16, wherein the scale is positioned at the tip of the body.

* * * * *

UNITED STATES PATENT AND TRADEMARK OFFICE

CERTIFICATE OF CORRECTION

PATENT NO. : 7,173,176 B2
APPLICATION NO. : 10/980946
DATED : February 6, 2007
INVENTOR(S) : Lance S. Nybye It is certified that error appears in the above-identified patent and that said Letters Patent is hereby corrected as shown below:

Claim 9, column 6, line 5, delete “at” and insert -- that --

Signed and Sealed this

Eighteenth Day of December, 2007

JON W. DUDAS
*Director of the United States Patent and Trademark Office*